US010096901B2

(12) United States Patent
Banba

(10) Patent No.: US 10,096,901 B2
(45) Date of Patent: Oct. 9, 2018

(54) COIL MODULE

(71) Applicant: Murata Manufacturing Co., Ltd., Kyoto (JP)

(72) Inventor: Shinichiro Banba, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 151 days.

(21) Appl. No.: 15/067,860

(22) Filed: Mar. 11, 2016

(65) Prior Publication Data

US 2016/0268687 A1 Sep. 15, 2016

(30) Foreign Application Priority Data

Mar. 12, 2015 (JP) ..... 2015-049926

(51) Int. Cl.
*H01Q 7/00* (2006.01)
*H01Q 1/22* (2006.01)
*H01Q 1/40* (2006.01)

(52) U.S. Cl.
CPC ..... *H01Q 7/00* (2013.01); *H01Q 1/2208* (2013.01); *H01Q 1/40* (2013.01)

(58) Field of Classification Search
CPC ..... H01Q 7/00; H01Q 1/2208; H01Q 1/40
USPC ..... 343/788
See application file for complete search history.

(56) References Cited

U.S. PATENT DOCUMENTS 4,905,318 A * 2/1990 Fukuda ..... H01L 43/06 257/422
5,870,006 A * 2/1999 Tada ..... H01P 1/2056 333/202
6,304,158 B1 * 10/2001 Nishijima ..... H01P 1/2056 333/134
6,459,588 B1 * 10/2002 Morizumi ..... G06K 19/07749 235/492
6,759,600 B2 * 7/2004 Koyama ..... H05K 1/036 174/255
8,596,545 B2 12/2013 Kato
2002/0003299 A1 * 1/2002 Nakamura ..... H01L 23/49816 257/734

(Continued)

FOREIGN PATENT DOCUMENTS

CN 102047500 A 5/2011
CN 106233310 A 12/2016

(Continued)

*Primary Examiner* — Dieu H Duong
*Assistant Examiner* — Bamidele A Jegede
(74) *Attorney, Agent, or Firm* — Pearne & Gordon LLP

(57) ABSTRACT

A coil module includes a substrate layer, a coil electrode, and a sealing resin layer. The coil electrode includes metal pins that stand on a resin substrate of the substrate layer in such a way that lower end surfaces thereof are exposed on a lower surface of the substrate layer. The sealing resin layer is stacked on the substrate layer and covers the metal pins. Upper end surfaces of the metal pins are exposed on an upper surface of the sealing resin layer. Each of the metal pins and a corresponding one of the metal pins paired therewith are connected to each other on the lower surface of the substrate layer through a lower wiring pattern. Each of the pins and a corresponding one of the metal pins are connected to each other on the upper surface of the substrate layer through an upper wiring pattern.

23 Claims, 9 Drawing Sheets

(56) References Cited

U.S. PATENT DOCUMENTS

| | | | | |
|---|---|---|---|---|
| 2003/0076196 | A1* | 4/2003 | Nakamura | H01P 1/2136 333/134 |
| 2006/0255797 | A1* | 11/2006 | Taylor | G01R 15/207 324/262 |
| 2008/0224946 | A1* | 9/2008 | Lee | H01Q 1/2283 343/895 |
| 2009/0053459 | A1* | 2/2009 | Hirose | H01L 23/49811 428/76 |
| 2011/0062244 | A1* | 3/2011 | Kato | G06K 19/07749 235/492 |
| 2011/0101113 | A1* | 5/2011 | Koujima | G06K 19/07771 235/492 |
| 2014/0035793 | A1* | 2/2014 | Kato | H01Q 1/243 343/867 |
| 2014/0043196 | A1* | 2/2014 | Gouchi | H01Q 7/06 343/788 |
| 2014/0203985 | A1* | 7/2014 | Tsubaki | H01Q 7/08 343/788 |
| 2014/0218417 | A1 | 8/2014 | Kenichi | |
| 2017/0026089 | A1 | 1/2017 | Kato et al. | |

FOREIGN PATENT DOCUMENTS

| | | | |
|---|---|---|---|
| JP | H08-203762 | A | 8/1996 |
| JP | 2014168038 | | 9/2014 |
| WO | 2009145218 | A1 | 10/2011 |

* cited by examiner

COIL MODULE

BACKGROUND OF THE DISCLOSURE

1. Field of the Disclosure

The present disclosure relates to a coil module including a wiring substrate and a coil electrode.

2. Description of the Related Art

FIG. 9 illustrates an existing coil module including a wiring substrate and a coil. A coil module 100 includes a wiring substrate 101, an annular coil core 102 disposed on the upper surface of the wiring substrate 101, and a coil electrode 103 that is helically wound around the coil core 102. The coil electrode 103 includes a plurality of wiring films 103*a* and a plurality of upper wiring conductors 103*b* (see Japanese Unexamined Patent Application Publication No. 8-203762 (paragraphs 0012 to 0015, FIG. 1, and others).

Each of the wiring films 103*a* is formed on the upper surface of the wiring substrate 102 in such a way that a first end portion thereof is disposed inside of the coil core 102 and a second end portion thereof is disposed outside of the coil core 102. The wiring films 103*a* are arranged in the circumferential direction of the coil core 102. Each of the upper wiring conductors 103*b* is a jumper wire having a substantially angular U-shape. The upper wiring conductors 103*b* stand on the wiring substrate 101 so as to surround the outer side surface, the inner side surface, and the upper surface of the coil core 102. A first end of each of the upper wiring conductors 103*b* is connected to the first end portion (located inside the coil core 102) of a corresponding one of the wiring films 103*a*. A second end of each of the upper wiring conductors 103*b* is connected to the second end portion (located outside of the coil core 102) of a corresponding one of the wiring films 103*a*. The upper wiring conductors 103*b* and the wiring films 103*a* constitute the coil electrode 103, which is helically wound around the coil core 102.

When the coil module 100 has such a structure, a coil can be formed without manually winding a metal wire around the coil core. Therefore, the manufacturing cost of the coil module 100 can be reduced.

In the coil module 100, the wiring films 103*a* and the upper wiring conductors 103*b* are joined to each other by using a solder. Therefore, if there is a possibility that a product including the coil module 100 is used in an environment in which temperature is higher than the melting point of an ordinary solder, the reliability of the joints between the wiring films 103*a* and the upper wiring conductors 103*b* might decrease. This may be avoided by using a high-melting-point solder or the like, which can withstand a high-temperature environment in which the product is to be placed. However, there is a problem in that, when the thicknesses of the wiring films 103*a* and the upper wiring conductors 103*b* are reduced in order to reduce the size and increase the functionality of the coil module 100, the areas of the joints between the wiring films 103*a* and the upper wiring conductors 103*b* are reduced and it is difficult to obtain a desired joint strength. Moreover, there is another problem in that it is difficult to correctly position the upper wiring conductors 103*b*, because the upper wiring conductors 103*b*, which are joined to the wiring films 103*a*, may fall or tilt.

BRIEF SUMMARY OF THE DISCLOSURE

Accordingly, it is an object of the present disclosure to improve the heat resistant properties of a coil module including a wiring substrate and a coil electrode.

According to preferred embodiments of the present disclosure, a coil module includes a substrate layer including a wiring substrate and a resin substrate that are exposed on a first main surface of the substrate layer, a coil electrode including a plurality of columnar conductors each of which stands on the resin substrate in such a way that a first end thereof is exposed on the first main surface of the substrate layer, and a sealing resin layer that is stacked on a second main surface of the substrate layer and covers the columnar conductors. A second end of each of the columnar conductors is exposed on an opposite surface of the sealing resin layer opposite to a stacking surface of the sealing resin layer stacked on the substrate layer. Each of the columnar conductors and a corresponding one of the columnar conductors paired therewith are connected to each other on the first main surface of the substrate layer through a first conductive layer. Each of the columnar conductors and a corresponding one of the columnar conductors paired therewith are connected to each other on the opposite surface of the sealing resin layer through a second conductive layer.

With this structure, because each of the columnar conductors of the coil electrode stands on the resin substrate in such a way that the first end thereof is exposed on the first main surface of the substrate layer, it is not necessary to use a solder in order to stand the columnar conductors on the substrate layer as in existing technology. The first end of each of the columnar conductors is exposed on the first main surface of the substrate layer, and the second end of each of the columnar conductors is exposed on the opposite surface of the sealing resin layer opposite to the stacking surface of the sealing resin layer stacked on the substrate layer. Therefore, the coil electrode can be formed by, instead of using a solder, forming the conductive layers on the first main surface of the substrate layer and on the opposite surface of the sealing resin layer using, for example, a conductive paste or by plating. Therefore, the heat resistant properties, such as the connection reliability in a high temperature, of a coil module including a wiring substrate and a coil electrode can be improved.

With a structure in which columnar conductors are mounted on a main surface of a wiring substrate by using a solder, the fixing strength with which the columnar conductors are fixed to the wiring substrate decreases as the thickness of the columnar conductors decreases. In contrast, with the structure described above, because the first end of each of the columnar electrodes is supported by the resin of the resin substrate, the thickness of the columnar conductors does not affect the fixing strength with which the columnar conductors are fixed to the substrate layer.

Because a solder is not used to connect the columnar conductors to the conductive layers, so-called "solder splash", which is a short circuit between adjacent columnar conductors that may caused by molted solder, can be prevented. Moreover, the columnar conductors can be easily arranged at a small pitch.

With existing technology, in which columnar conductors are mounted on a main surface of a wiring substrate by using a solder, it is necessary to form land electrodes larger than the diameter of the columnar conductors. In contrast, with the structure of the present embodiment, land electrodes are not necessary, and therefore the size of the coil module can be reduced.

In the coil module, the columnar conductors may be metal pins. In this case, the resistivity of the entirety of the coil electrode can be reduced, because each of the metal pins has a lower resistivity than a via conductor, which is formed by filling a via hole with a conductive paste, or a post electrode, which is formed by plating. Therefore, for example, it is possible to provide a coil module having good coil characteristics, such as the Q-factor.

In the coil module, the coil electrode may be an antenna coil. In this case, the present disclosure can be applied to a coil module that is used as an antenna coil. Because the first end of each of the columnar conductors is exposed on the first main surface of the substrate layer, that is, each of the columnar conductors extends through the substrate layer, the length of the columnar conductors can be made greater than that of an existing structure in which columnar conductors are mounted on a main surface of a wiring substrate (substrate layer) by using a solder. Thus, the length of the antenna coil can be increased, and therefore the antenna characteristics (such as the sensitivity) can be improved. Moreover, the fixing strength with which columnar conductors are fixed to the substrate layer can be increased, and therefore the thickness of the columnar conductors can be easily reduced and the length of the columnar conductors can be easily increased.

In the coil module, the sealing resin layer may be made of a resin including magnetic powder. With this structure, the inductance of the coil electrode can be increased.

In the coil module, the resin substrate of the substrate layer may include a first resin substrate and a second resin substrate that are disposed with the wiring substrate therebetween (in plan view in a direction perpendicular to the first main surface of the substrate layer), and the plurality of columnar conductors may be paired so that one of the columnar conductors of each pair stands on the first resin substrate and the other columnar conductor of the pair stands on the second resin substrate. By disposing pairs of the columnar conductors in such a way that the wiring substrate is located between each pair of the columnar conductors, that is, in such a way that one of the columnar conductors of each pair stands on the first resin substrate and the other columnar conductor of the pair stands on the second resin substrate, the length of conductive layers connecting pairs of the columnar conductors can be increased.

In the coil module, the first conductive layer may be disposed on the first main surface of the substrate layer so as to extend across the wiring substrate. In this case, the first main surface of the wiring substrate can be used to form the first conductive layer.

In the coil module, a part of the first conductive layer on the first main surface of the substrate layer may be disposed on the wiring substrate. In this case, the flexibility in designing the wiring pattern of the conductive layers can be increased.

In the coil module, the coil electrode may be wound so as to generate magnetic flux in a direction parallel to the first main surface or the second main surface of the substrate layer. In this case, as compared with a case where a coil electrode is helically wound so as to generate magnetic flux in a direction perpendicular to a main surface of a wiring substrate, magnetic flux is not likely to be blocked by a component or the like mounted on the wiring substrate, and therefore the antenna sensitivity can be improved.

With the present disclosure, because each of the columnar electrodes of the coil electrode stands on the resin substrate in such a way that the first end of the columnar electrode is exposed on the first main surface of the substrate layer, it is not necessary to use a solder in order to stand the columnar conductors on the substrate layer as in existing technology. The first end of each of the columnar conductors is exposed on the first main surfaces of the substrate layer and the second end of each of the columnar conductors is exposed on the opposite surface of the sealing resin layer opposite to a stacking surface of the sealing resin layer stacked on the substrate layer. Therefore, by forming the conductive layers on the first surface of the substrate layer and on the opposite surface of the sealing resin layer by using a conductive paste or by plating, the coil electrode can be formed without using a solder. Therefore, the heat resistant properties of a coil module, including a wiring substrate and a coil electrode, can be improved.

Other features, elements, characteristics and advantages of the present disclosure will become more apparent from the following detailed description of preferred embodiments of the present disclosure with reference to the attached drawings.

DETAILED DESCRIPTION OF THE DISCLOSURE

First Embodiment

Figure 1:
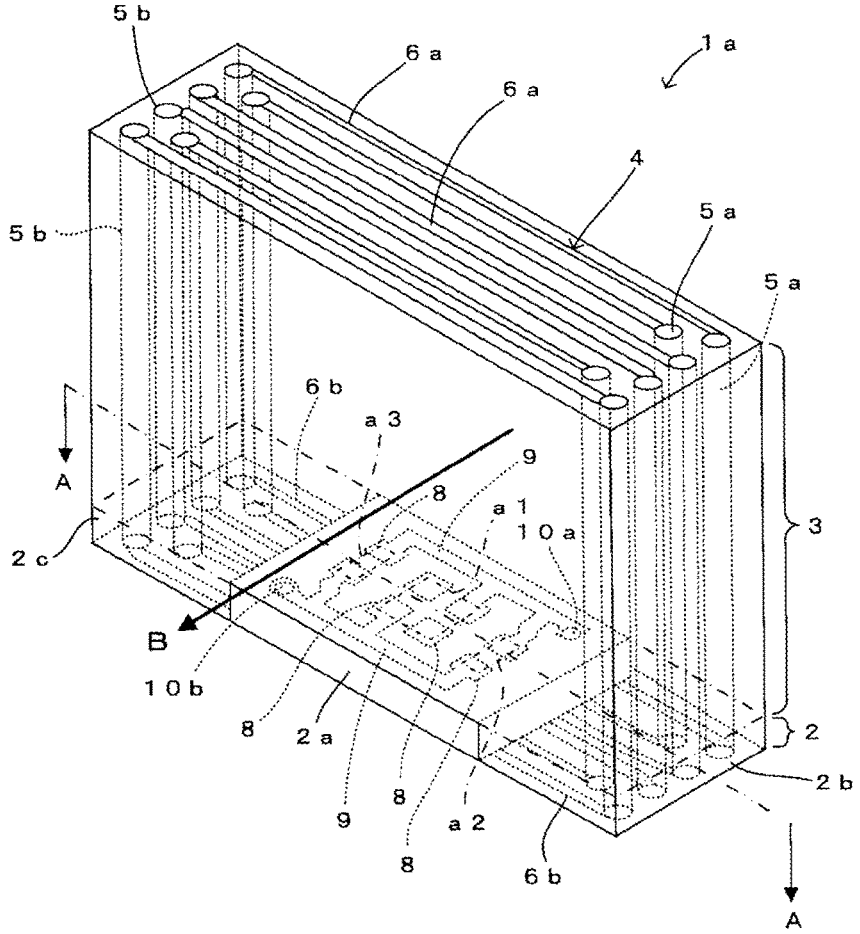
FIG. 1 is a perspective view of a coil module according to a first embodiment of the present disclosure.
Figure 2A:
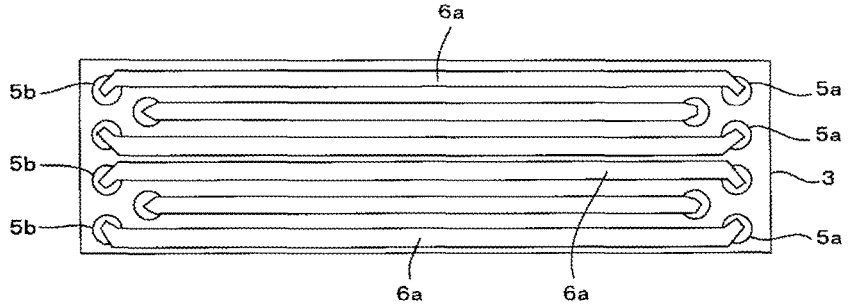
FIGS. 2A to 2C illustrate a coil electrode shown in FIG. 1.
Figure 2B:
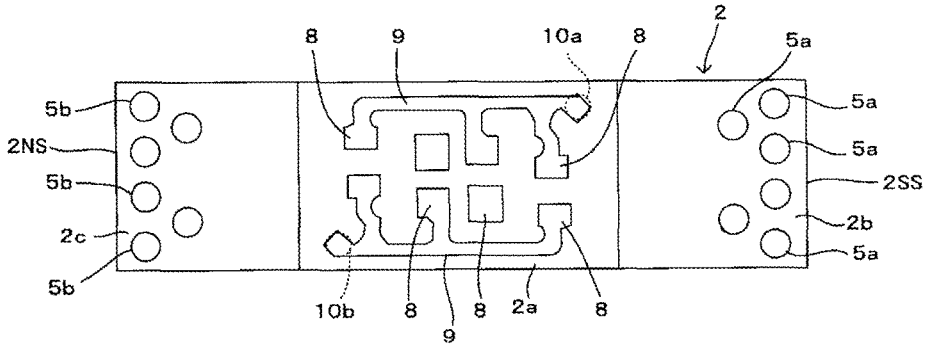
Figure 2C:
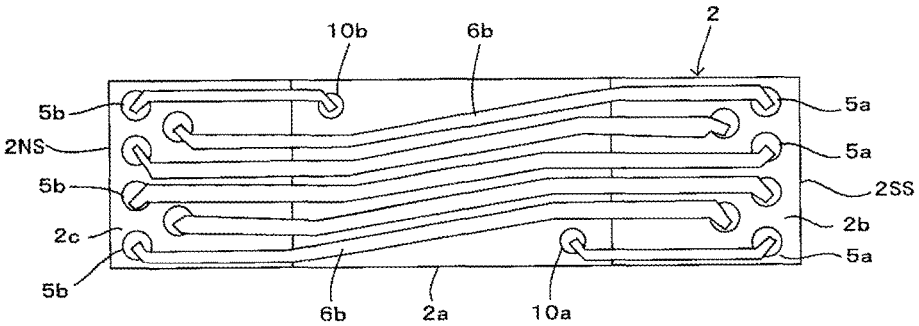

Referring to FIGS. 1 to 2C, a coil module 1*a* according to a first embodiment of the present disclosure will be described. FIG. 1 is a perspective view of the coil module 1*a*, and FIGS. 2A to 2C illustrate a coil electrode. In FIGS. 1 and 2B, components 7*a* to 7*c*, which are mounted on a wiring substrate 2*a*, are omitted. FIG. 2A is a plan view of the coil module 1*a*; FIG. 2B is a sectional view of the coil module 1*a* taken in the direction of arrows A-A in FIG. 1, illustrating a plan view of a substrate layer 2; and FIG. 2C is a bottom view of the coil module 1*a*.

As illustrated in FIG. 1, the coil module 1*a* according to the present embodiment includes the substrate layer 2; the components 7*a*, 7*b*, and 7*c* (shown in FIGS. 3B and 3C), which are mounted on the upper surface of the wiring substrate 2*a* of the substrate layer 2; a sealing resin layer 3, which is stacked on the upper surface of the substrate layer 2; and a coil electrode 4. The coil electrode 4 of the coil module 1*a* according to the present embodiment is an antenna coil, which is used as an antenna module for radio-frequency identification (RFID).

The substrate layer 2 has a plate-like shape and includes the wiring substrate 2*a*, a first resin substrate 2*b*, and a second resin substrate 2*c*, which are arranged along a plane. The wiring substrate 2*a* is disposed between the first resin substrate 2*b* and the second resin substrate 2*c*. In the present embodiment, the substrate layer 2 has a rectangular shape in plan view in the thickness direction thereof.

The wiring substrate 2*a* is, for example, a glass epoxy substrate. Land electrodes 8, for mounting the components 7*a* to 7*c* thereon, and wiring electrodes 9 are disposed on the upper surface of the wiring substrate 2*a*. Two via conductors 10*a* and 10*b* extend through the wiring substrate 2*a* in the thickness direction. The via conductors 10*a* and 10*b* each connect a predetermined one of the wiring electrodes 9 on the upper surface of the wiring substrate 2*a* to one end or the other end of the coil electrode 4 on the lower surface of the wiring substrate 2*a*. In the present embodiment, the component 7*a*, which is mounted on a region a1 at substantially the center of the wiring substrate 2*a*, is a semiconductor device (such as an RFIC). Two components 7*b* and 7*c*, which are mounted on two regions a2 and a3 on both sides of the region a1, are chip capacitors.

The first and second resin substrates 2*b* and 2*c* are made of, for example, an epoxy resin and function as a fixing substrate that enables metal pins 5*a* and 5*b* (described below) to stand on the substrate layer 2. In the present embodiment, the shapes of the wiring substrate 2*a* and the first and second resin substrates 2*b* and 2*c* in plan view in the thickness direction are rectangular. The resin material of the first and second resin substrates 2*b* and 2*c* is not limited to an epoxy resin. The first and second resin substrates 2*b* and 2*c* may be made of any resin that can function as a fixing member for fixing the metal pins 5*a* and 5*b* in place.

The coil electrode 4 includes the plurality of metal pins 5*a* and 5*b*, a plurality of upper wiring patterns 6*a*, and a plurality of lower wiring patterns 6*b*. The metal pins 5*a* and 5*b* include the first metal pins 5*a*, which stand on the first resin substrate 2*b*, and the second metal pins 5*b*, which stand on the second resin substrate 2*c*. Each of the second metal pins 5*b* is paired with a corresponding one of the first metal pins 5*a*. Each of the first and second metal pins 5*a* and 5*b* is disposed in such a way that a lower end surface thereof (corresponding to "a first end of each of the columnar conductors" in the present disclosure) is exposed on a lower surface of the substrate layer 2 (corresponding to "a first main surface of a substrate layer" in the present disclosure).

As illustrated in FIG. 2B, the first metal pins 5*a* are disposed adjacent to a short side 2SS of the substrate layer 2, and the second metal pins 5*b* are disposed adjacent to a short side 2NS, facing the short side 2SS, of the substrate layer 2. Accordingly, the upper or lower wiring pattern 6*a* or 6*b*, which connect pairs of the metal pins 5*a* and 5*b*, can have greater lengths. The metal pins 5*a* and 5*b* are made of a metal that is generally used as the material of a wiring electrode, such as Cu, Au, Ag, Al or a Cu-based alloy. In the present embodiment, the metal pins 5*a* and 5*b* have solid-cylindrical shapes having the same diameter and the same length.

The upper wiring patterns 6*a* are formed on the upper surface of the sealing resin layer 3 (corresponding to "an opposite surface of the sealing resin layer opposite to a stacking surface of the sealing resin layer stacked on the substrate layer" in the present disclosure). Each of the upper wiring patterns 6*a* connects the upper end surfaces of a corresponding pair of the metal pins 5*a* and 5*b* (corresponding to "a second end of each of the columnar conductors" in the present disclosure) to each other. The lower wiring patterns 6*b* are formed on the lower surface of the substrate layer 2. Each of the lower wiring patterns 6*b* connects a corresponding pair of the metal pins 5*a* and 5*b* of the coil electrode 4 (corresponding to "a first end of each of the columnar conductors" in the present disclosure) to each other.

As illustrated in FIG. 2A, in the present embodiment, in plan view, each pair of the first and second metal pins 5*a* and 5*b* are disposed on a line that is substantially parallel to a long side of the substrate layer 2 in such a way that the wiring substrate 2*a* is disposed between the first and second metal pins 5*a* and 5*b*. Each of the upper wiring patterns 6*a* connect the upper end surfaces of a corresponding one of the pairs of the first and second metal pins 5*a* and 5*b* to each other. As illustrated in FIG. 2C, each of the lower wiring patterns 6*b* does not connect the lower end surfaces of one of the first metal pins 5*a* and a corresponding one of the second metal pins 5*b* that are paired with each other on the upper end surface. Instead, for example, each of the lower wiring patterns 6*b* connects the lower end surface of one of the second metal pins 5*b* and the lower end surface of one of the first metal pins 5*a* adjacent to another one of the first metal pins 5*a* to which the upper end surface of the one of the second metal pins 5*b* is connected through a corresponding one of the upper wiring patterns 6*a*. A part of each of the lower wiring patterns 6*b* is formed on the lower surface of the wiring substrate 2*a*. With such a structure, the coil electrode 4 is helically wound in the coil module 1*a*. Each of the upper wiring patterns 6*a* corresponds to "a second conductive layer" in the present disclosure, and each of the lower wiring patterns 6*b* corresponds to "a first conductive layer" in the present disclosure.

In the present embodiment, each of the upper and lower wiring patterns 6*a* and 6*b* includes an underlying electrode layer (not shown) and a surface electrode layer. The underlying electrode layer is formed on the upper surface of the sealing resin layer 3 or the lower surface of the substrate layer 2 and is made of a conductive paste including a metal filler made of Cu, Ag, Al, or the like. The surface electrode layer is formed by plating the underlying electrode layer with Cu or the like. The surface electrode layer may be omitted. The surface electrode layer may be additionally plated with Ni/Au. The upper and lower wiring patterns 6*a* and 6*b* may be directly formed by performing metal plating. The upper and lower wiring patterns 6*a* and 6*b* may be formed by a method including forming a Cu layer on a surface and then etching the Cu layer (subtractive method), a semi-additive method performed after forming a plating resist, or a sputtering method.

The sealing resin layer 3 is stacked on the upper surface of the substrate layer 2 (corresponding to "a second main surface of the substrate layer" in the present disclosure) so as to cover the metal pins 5*a* and 5*b* and the components 7*a* to 7*c*. The sealing resin layer 3 covers the metal pins 5*a* and 5*b* in such a way that the upper end surfaces of the metal pins 5*a* and 5*b* are exposed on the upper surface of the sealing resin layer 3. The sealing resin layer 3 can be made from, for example, a resin, such as an epoxy resin, including magnetic powder. The sealing resin layer 3 need not include magnetic powder and may be a general resin that is used to seal an electronic component.

Method of Manufacturing Coil Module

Figure 3A:
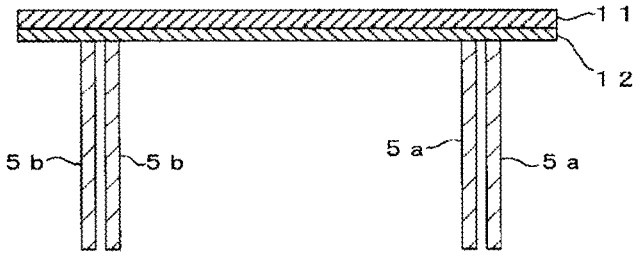
FIGS. 3A to 3D illustrate a method of manufacturing the coil module shown in FIG. 1.
Figure 3B:
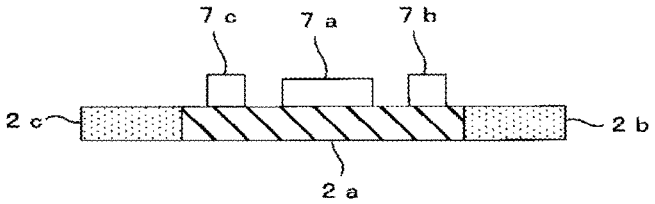
Figure 3C:
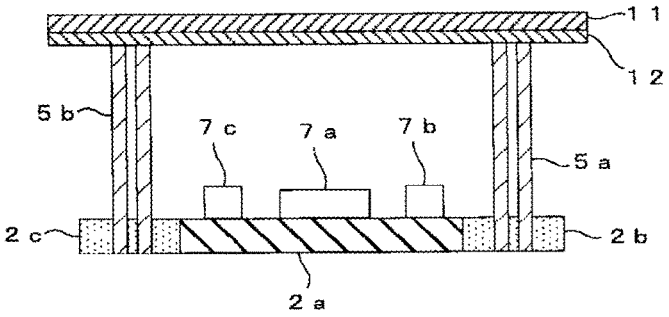
Figure 3D:
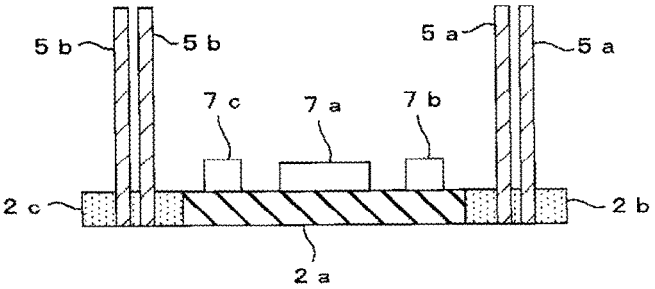
Figure 4A:
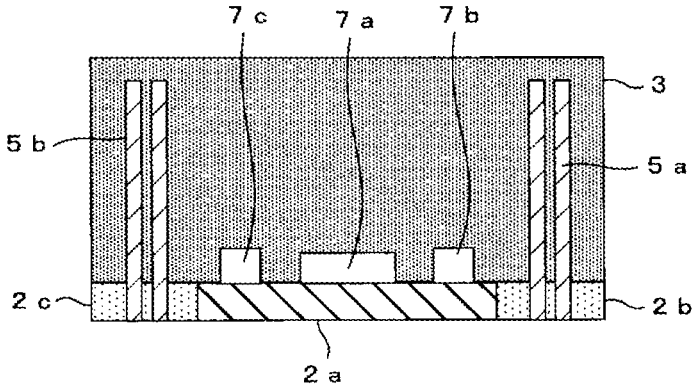
FIGS. 4A to 4C illustrate the method of manufacturing the coil module shown in FIG. 1.
Figure 4B:
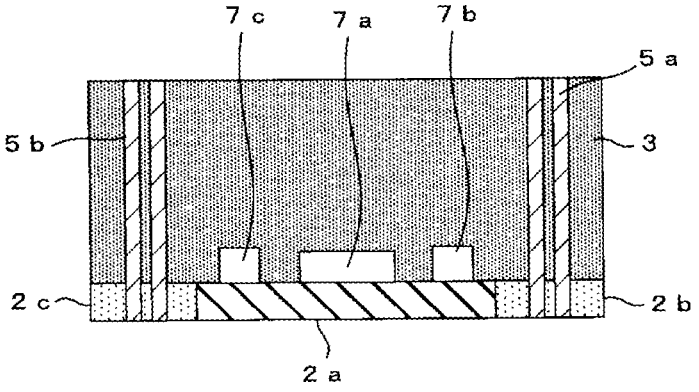
Figure 4C:
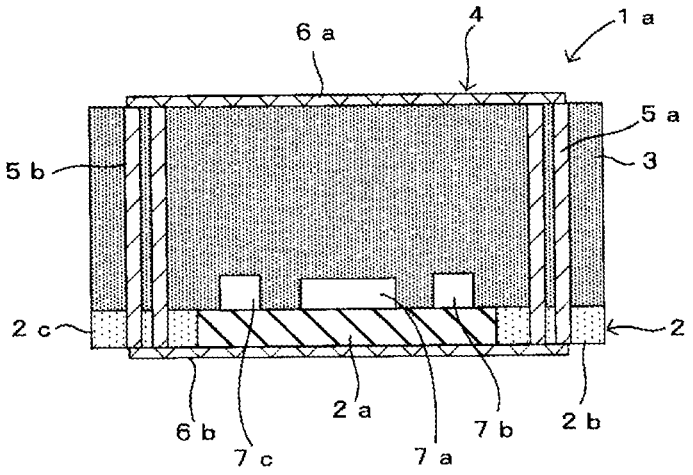
Figure 5A:
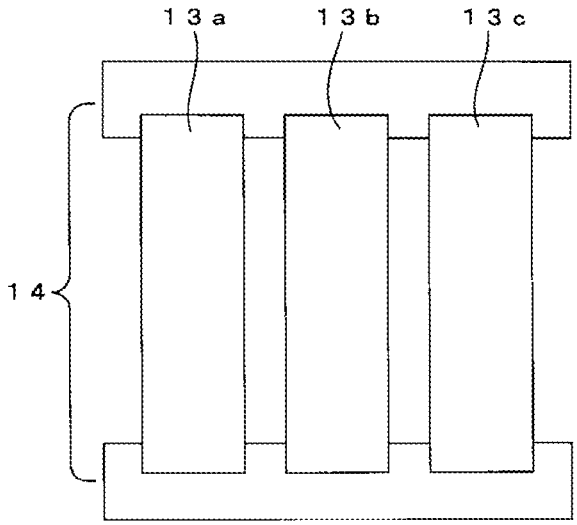
FIGS. 5A to 5C illustrate a method of forming a substrate layer shown in FIG. 1.
Figure 5B:
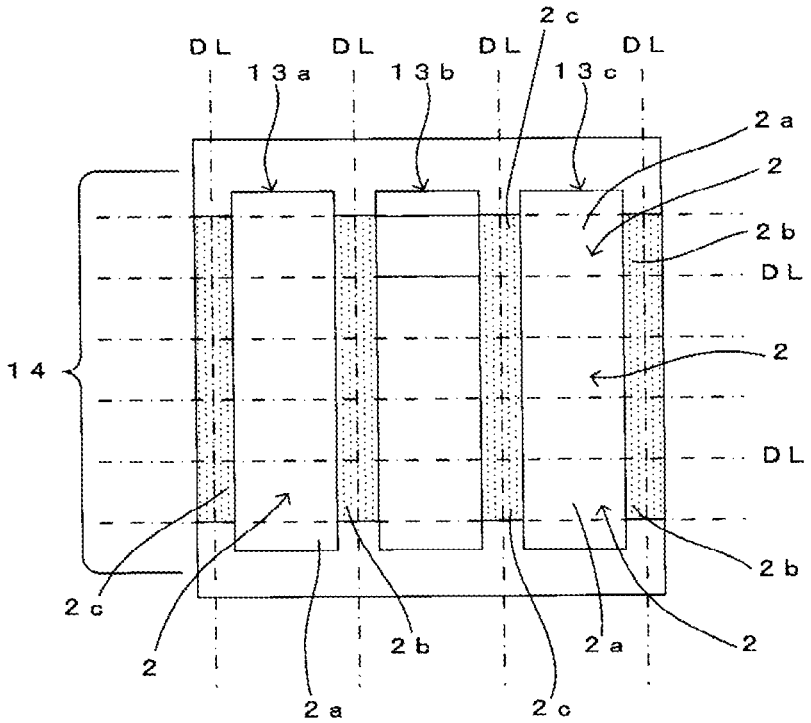
Figure 5C:
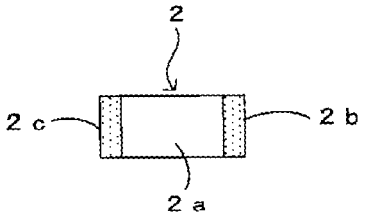

Referring to FIGS. 3A to 4C, an example of a method of manufacturing the coil module 1*a* will be described. FIGS. 3A to 3D illustrate the steps of the method of manufacturing the coil module 1*a*. FIGS. 4A to 4C illustrate the subsequent steps of the method. FIGS. 5A to 5C illustrate the steps of a method of forming the substrate layer 2.

First, as illustrated in FIG. 3A, a planar transfer plate 11 to which the metal pins 5*a* and 5*b* are fixed so as to stand on one of the main surfaces of the transfer plate 11, is prepared. To be specific, the upper end surfaces of the metal pins 5*a* and 5*b* are placed at the predetermined positions on one of the main surfaces of the transfer plate 11 and bonded to the main surface. Each of the metal pins 5*a* and 5*b* can be made by, for example, shearing a metal wire (such as a wire made of Cu, Au, Ag, Al, or a Cu-based alloy) having a circular cross section. A bonding layer 12 is affixed to the main surface of the transfer plate 11 so that the metal pins 5*a* and 5*b* can be fixed to the transfer plate 11 via the bonding layer 12.

Next, the components 7*a* to 7*c* are mounted on the wiring substrate 2*a*. The wiring substrate 2*a* includes the land electrodes 8, the wiring electrodes 8, and the via conductors 10*a* and 10*b*, which have been formed by using known technology. Each of the components 7*a* to 7*c* is mounted on a corresponding one of the land electrodes 8 by using a solder. The components 7*a* to 7*c* may be mounted by using, instead of a solder, another surface mount technology, such as ultrasonic bonding. The order of the step of preparing the transfer plate 11 to which the metal pins 5*a* and 5*b* are fixed and the step of preparing the wiring substrate 2*a* on which the components 7*a* to 7*c* are mounted may be reversed.

Next, as illustrated in FIG. 3B, the substrate layer 2, having a plate-like shape and including the wiring substrate 2*a* and the first and second resin substrates 2*b* and 2*c* arranged along a plane, is prepared. In the present embodiment, the substrate layer 2 is formed, for example, through a manufacturing process in which a collective body including a plurality of the coil modules 1*a* is formed first, and then the collective body is divided into independent coil modules 1*a*.

For example, as illustrated in FIG. 5A, three rectangular collective substrates 13*a* to 13*c*, in each of which a plurality of the wiring substrates 2*a* are integrally formed and arranged vertically, are prepared. The rectangular collective substrates 13*a* to 13*c* are fixed to each other by using a fixing jig 14 so as to be disposed parallel to each other and separated from each other by substantially the same distance.

Next, as illustrated in FIG. 5B, the first and second resin substrates 2*b* and 2*c* are formed by filling the gaps between the rectangular collective substrates 13*a* to 13*c* with, for example, an epoxy resin. The gaps may be filled with a resin by using any appropriate method, such as an application method or a printing method. Thus, the substrate layer 2 shown in FIG. 3B is formed. In this state, the first and second resin substrates 2*b* and 2*c* are uncured or half-cured. In the present embodiment, the upper surfaces of the wiring substrate 2*a* and the first and second resin substrates 2*b* and 2*c* extend along a plane. However, the resins of the first and second resin substrates 2*b* and 2*c* may cover boundary portions (between the wiring substrate 2*a* and the first or second resin substrates 2*b* or 2*c*) of the upper surface of the wiring substrate 2*a*.

In FIG. 3B, the upper surfaces of the first and second resin substrates 2*b* and 2*c* are flush with the upper surface of the wiring substrate 2*a*, and the lower surfaces of the first and second resin substrates 2*b* and 2*c* are flush with the lower surface of the wiring substrate 2*a*. However, these surfaces need not be flush with each other. The expression "a wiring substrate and a resin substrate exposed on a first main surface" includes a case where the upper surfaces of the first and second resin substrates 2*b* and 2*c* are not flush with the upper surface of the wiring substrate 2*a* and a case where the lower surfaces of the first and second resin substrates 2*b* and 2*c* are not flush with the lower surface of the wiring substrate 2*a*. Typically, the substrate layer 2 has a plate-like shape.

Next, as illustrated in FIG. 3C, lower end portions of the metal pins 5*a* and 5*b*, which have been fixed to the transfer plate 11, are embedded in the first and second resin substrates 2*b* and 2*c*, which are uncured or half-cured. Subsequently, the resins of the first and second resin substrates 2*b* and 2*c* are completely cured. The metal pins 5*a* and 5*b* are disposed in such a way that the lower end surfaces thereof are exposed on the lower surfaces of the first and second resin substrates 2*b* and 2*c* and the peripheral side surfaces thereof are covered by the resins of the first or second resin substrates 2*b* and 2*c*. Subsequently, the resins of the first and second resin substrates 2*b* and 2*c* are cured in a predetermined curing temperature. By doing so, the metal pins 5*a* and 5*b* can be fixed to the substrate layer 2 so as to stand on the substrate layer 2 without using a solder. Moreover, the metal pins 5*a* and 5*b* can be more securely fixed to the substrate layer 2 than by using a solder. Furthermore, because the fixing strength with which the metal pins 5*a* and 5*b* are fixed to the substrate layer 2 increases, the metal pins 5*a* and 5*b* can be handled more easily in the subsequent steps.

Next, as illustrated in FIG. 3D, after removing the transfer plate 11, by using a resin including magnetic powder, the sealing resin layer 3 is formed on the upper surface of the substrate layer 2 so as to cover the metal pins 5*a* and 5*b* and the components 7*a* to 7*c* (see FIG. 4A).

Next, as illustrated in FIG. 4B, the upper surface of the sealing resin layer 3 is polished or ground so that the upper end surfaces of the metal pins 5*a* and 5*b* are exposed on the upper surface of the sealing resin layer 3. As necessary, the lower surface of the substrate layer 2 may be polished or ground so that the lower end surfaces of the metal pins 5*a* and 5*b* are exposed on the lower surface of the substrate layer 2 without fail.

Next, as illustrated in FIG. 4C, the upper wiring patterns 6*a* are formed on the upper surface of the sealing resin layer 3, and the lower wiring patterns 6*b* are formed on the lower surface of the substrate layer 2. Each of the wiring patterns 6*a* and 6*b* can be formed, for example, by forming an underlying electrode layer by screen printing by using a conductive paste including a metal, which is one of Cu, Ag, and Al, and by subsequently forming a surface electrode layer by plating the underlying layer with a metal, such as Cu. Protective films (not shown), for protecting the wiring patterns 6*a* and 6*b*, may be formed on the upper surface of the sealing resin layer 3 and the lower surface of the substrate layer 2. In this case, the protective films may be made of an epoxy resin or a polyimide resin.

Finally, the collective body is diced along dicing lines DL shown in FIG. 5B, thereby obtaining independent coil modules 1*a* (see FIGS. 4C and 5C).

In the present embodiment, the lower end surfaces of the metal pins 5*a* and 5*b* are exposed on the lower surface of the substrate layer 2, and the upper end surfaces of the metal pins 5*a* and 5*b* are exposed on the upper surface of the sealing resin layer 3. Therefore, the coil electrode 4 can be formed by, instead of using a solder, forming the wiring patterns 6*a* and 6*b* on the lower surface of the substrate layer 2 and on the upper surface of the sealing resin layer 3 using, for example, a conductive paste. Therefore, the heat resistant properties, such as the connection reliability in a high temperature, of a coil module including a wiring substrate and a coil electrode can be improved.

With a structure in which columnar conductors are mounted on a main surface of a wiring substrate by using a solder, the fixing strength with which the columnar conductors are fixed to the wiring substrate decreases as the thickness of the columnar conductors decreases. In contrast, with the structure of the present embodiment, because the lower end portions of the metal pins 5*a* and 5*b* are supported by the resins of the first and second resin substrates 2*b* and 2*c*, the diameter of the metal pins 5*a* and 5*b* does not affect the strength with which the metal pins 5*a* and 5*b* are fixed to the substrate layer 2.

Because a solder is not used to connect the metal pins 5*a* and 5*b* to the wiring patterns 6*a* and 6*b*, so-called "solder splash", which is a short circuit between adjacent metal pins 5*a* or 5*b* that may be caused by melted solder, can be prevented. Moreover, the metal pins 5*a* and 5*b* can be easily arranged at a small pitch.

With existing technology, in which columnar conductors are mounted on a main surface of a wiring substrate by using a solder, it is necessary to form land electrodes larger than the diameter of the columnar conductors. In contrast, with the structure of the present embodiment, the substrate layer 2 need not have land electrodes for mounting the metal pins. Therefore, the size of the coil module 1*a* can be reduced.

Each of the metal pins 5*a* and 5*b*, which are made by, for example, shearing a metal wire, has a lower resistivity than a via conductor, which are formed by filling a via hole with a conductive paste, or a post electrode, which is formed by plating. Therefore, the resistivity of the entirety of the coil electrode 4 can be reduced. Therefore, for example, it is possible to provide the coil module 1*a* having good coil characteristics, such as Q-factor.

Because the metal pins 5*a* and 5*b* extend through the substrate layer 2 in the thickness direction, the length of the metal pins 5*a* and 5*b* can be made greater than that of a structure in which metal pins are mounted on a wiring substrate by the thickness of the substrate layer 2. In this case, the length of the entirety of the coil electrode 4 can be increased, and therefore the antenna characteristics (such as the sensitivity) of the coil electrode 4 can be improved.

For example, a flat antenna coil can be formed on one of main surfaces of a wiring substrate by forming a spiral coil pattern (of the antenna coil) on the main surface of the wiring substrate. In this case, an electric component may be disposed at the center of the spiral. With such a structure, because magnetic flux extend through the coil in a direction perpendicular to the main surface of the wiring substrate, the magnetic flux may be blocked by the electronic component, and the sensitivity of the antenna may be reduced due to the electronic component. In contrast, in the present embodiment, the coil electrode 4 is formed three-dimensionally. Therefore, the components 7*a* to 7*c* can be disposed away from the winding axis (center) of the coil electrode by adjusting the length of the metal pins 5*a* and 5*b* (increasing the length of the metal pins 5*a* and 5*b*), so that the antenna sensitivity can be improved.

In the antenna coil according to the present embodiment, the coil electrode 4 is helically wound so that magnetic flux extends through the coil in a direction substantially parallel to the main surface of the wiring substrate 2*a* (or the substrate layer 2) (a direction perpendicular to the plane of FIG. 4C, see arrow B in FIG. 1). Therefore, as compared with a case where magnetic flux extends in a direction perpendicular to the wiring substrate 2*a*, the components 7*a* to 7*c* (in particular, electrodes) are less likely to block the magnetic flux, so that the antenna sensitivity can be improved.

Because the sealing resin layer 3 is made of a resin including magnetic powder, the inductance of the coil electrode 4 can be improved.

The substrate layer 2 includes the first and second resin substrates 2*b* and 2*c* that are disposed with the wiring substrate 2*a* therebetween, and the metal pins 5*a* and 5*b*, which are paired, respectively stand on the first resin substrate 2*b* and the second resin substrate 2*c*. By disposing pairs of the metal pins 5*a* and 5*b* of the coil electrode 4 respectively on the first resin substrate 2*b* and the second resin substrate 2*c* in such a way that the wiring substrate 2*a* is disposed between each pair of the metal pins 5*a* and 5*b*, the length of the wiring patterns 6*a* and 6*b* can be increased, and therefore the antenna sensitivity of the coil electrode 4 can be improved.

Because a part of each of the lower wiring patterns 6*b* is disposed the lower surface of the wiring substrate 2*a*, the flexibility in designing the lower wiring patterns 6*b* can be improved.

By disposing all of the plurality of first metal pins 5*a* on the first resin substrate 2*b* and all of the plurality of second metal pins 5*b* on the second resin substrate 2*c*, for example, when bonding the metal pins 5*a* and 5*b* to the transfer plate 11, the number of turns and the length of the coil electrode 4 can be flexibly changed by appropriately changing the length, the diameter, and the arrangement of the metal pins 5*a* and 5*b*.

Modification of Method of Forming Substrate Layer

Figure 6A:
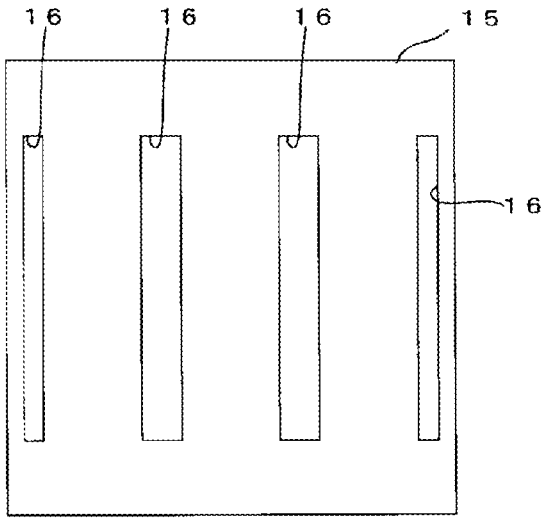
FIGS. 6A to 6C illustrate another method of forming the substrate layer shown in FIG. 1.
Figure 6B:
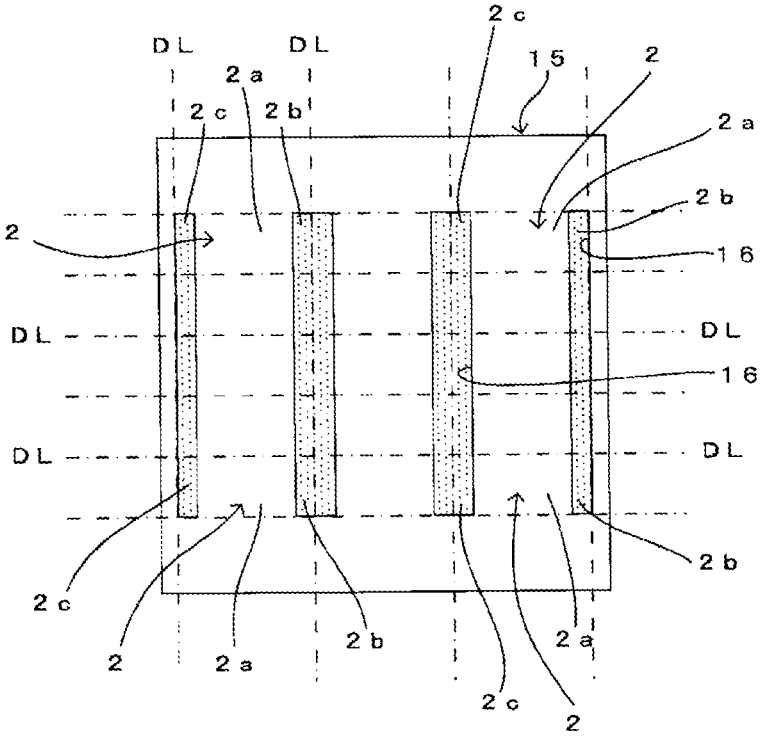
Figure 6C:
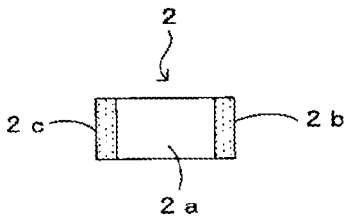

Next, referring to FIGS. 6A to 6C, a modification of the method of forming the substrate layer 2 will be described. FIGS. 6A to 6C illustrate the method of forming the substrate layer according to the present modification and respectively correspond to FIGS. 5A to 5C.

In the present modification, instead of fixing three rectangular collective substrates 13*a* to 13*c* by using the fixing jig 14 as described above, a collective substrate 15, in which the rectangular collective substrate 13*a* to 13*b* are integrally formed, is prepared, and through-holes 16 are formed at positions at which the first and second resin substrates 2*b* and 2*c* are to be disposed (see FIG. 6A). The through-holes 16 can be formed by, for example, laser processing or punch processing. The through-holes 16 are disposed in parts of the collective substrate 15 at which both ends of chips are to be located (both ends to which the metal pins 5*a* and 5*b* are to be fixed) when the collective substrate 15 is diced into the chips.

Next, as illustrated in FIG. 6B, the through-holes 16 are filled with a resin to become the first and second resin substrates 2*b* and 2*c*. Subsequently, by performing steps similar to those described above (see FIGS. 3C, 3D, and 4A to 4C), an independent coil module 1*a* is obtained (see FIGS. 4C and 6C). Also by using this method, the coil module 1*a* the same as that described above can be manufactured.

Second Embodiment

Figure 7:
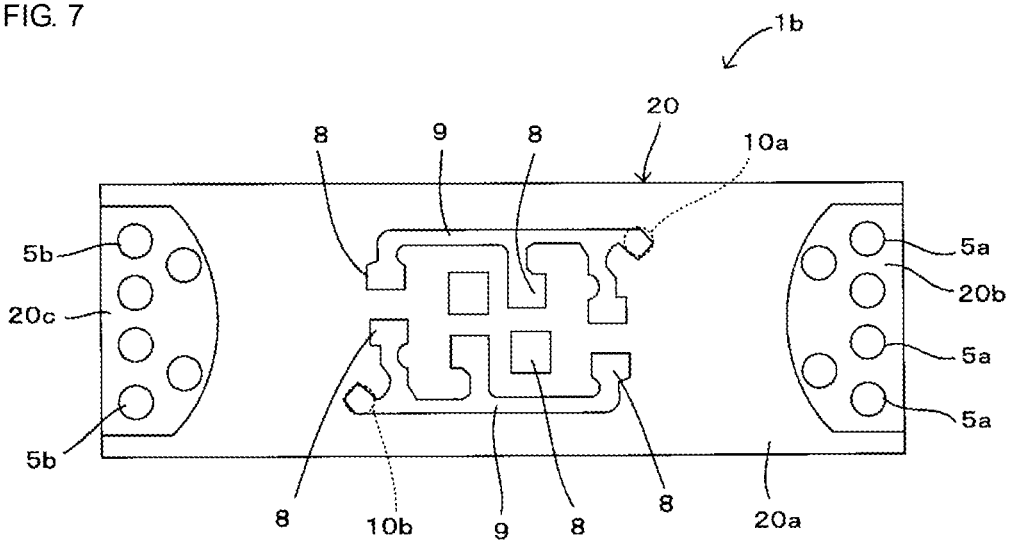
FIG. 7 illustrates a coil module according to a second embodiment of the present disclosure.

Referring to FIG. 7, a coil module 1*b* according to a second embodiment of the present disclosure will be described. FIG. 7 illustrates the coil module 1*b* and corresponds to FIG. 2B of the coil module 1*a* according to the first embodiment.

As illustrated in FIG. 7, the coil module 1*b* according to the present embodiment differs from the coil module 1*a* according to the first embodiment, which is illustrated in FIGS. 1 to 2C, in the structure of a substrate layer 20. In other respects, the coil module 1*b* is the same as the coil module 1*a* according to the first embodiment. Therefore, the same elements will be denoted by the same numerals and descriptions of such elements will be omitted.

As illustrated in FIG. 7, a wiring substrate 20*a* of the substrate layer 20 has a shape in plan view such that substantially semicircular portions are cut out from the left and right end portions of the rectangular shape. First and second resin substrates 20*b* and 20*c* are formed so as to fill the cutout portions, and the entirety of the substrate layer 20 has a rectangular shape in plan view.

As with the coil module 1*a* according to the first embodiment, the substrate layer 20 is formed in the process of dividing a collective body of the coil modules 1*b* into independent coil modules 1*b*.

Figure 8A:
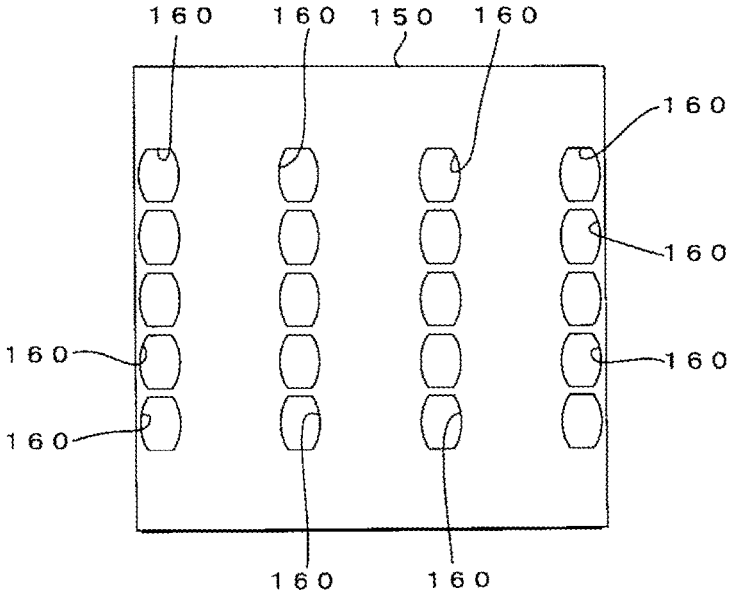
FIGS. 8A and 8B illustrate a method of forming a substrate layer of the coil module shown in FIG. 7.
Figure 8B:
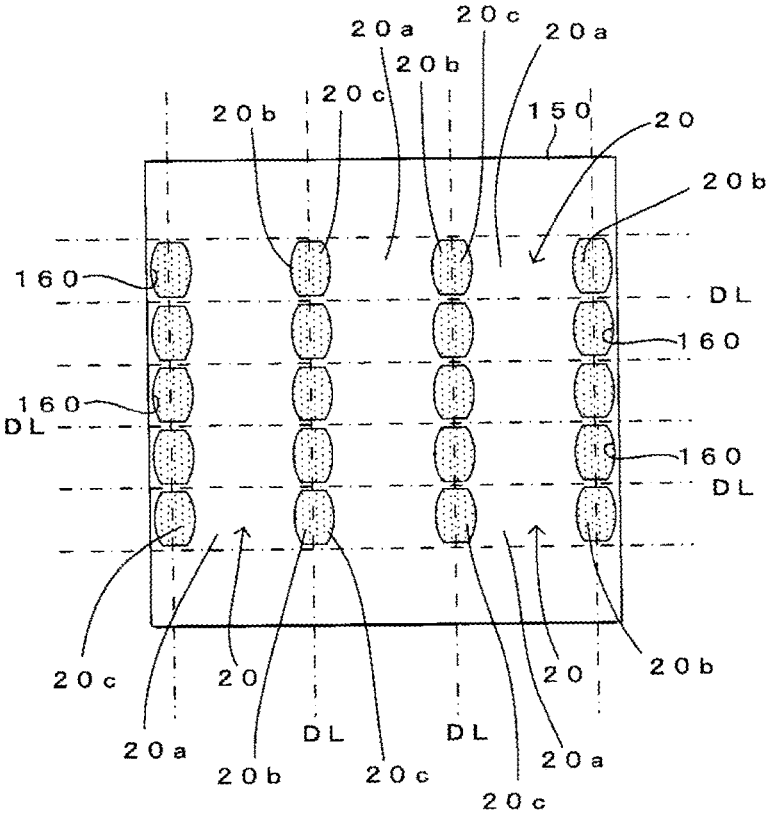
Figure 9:
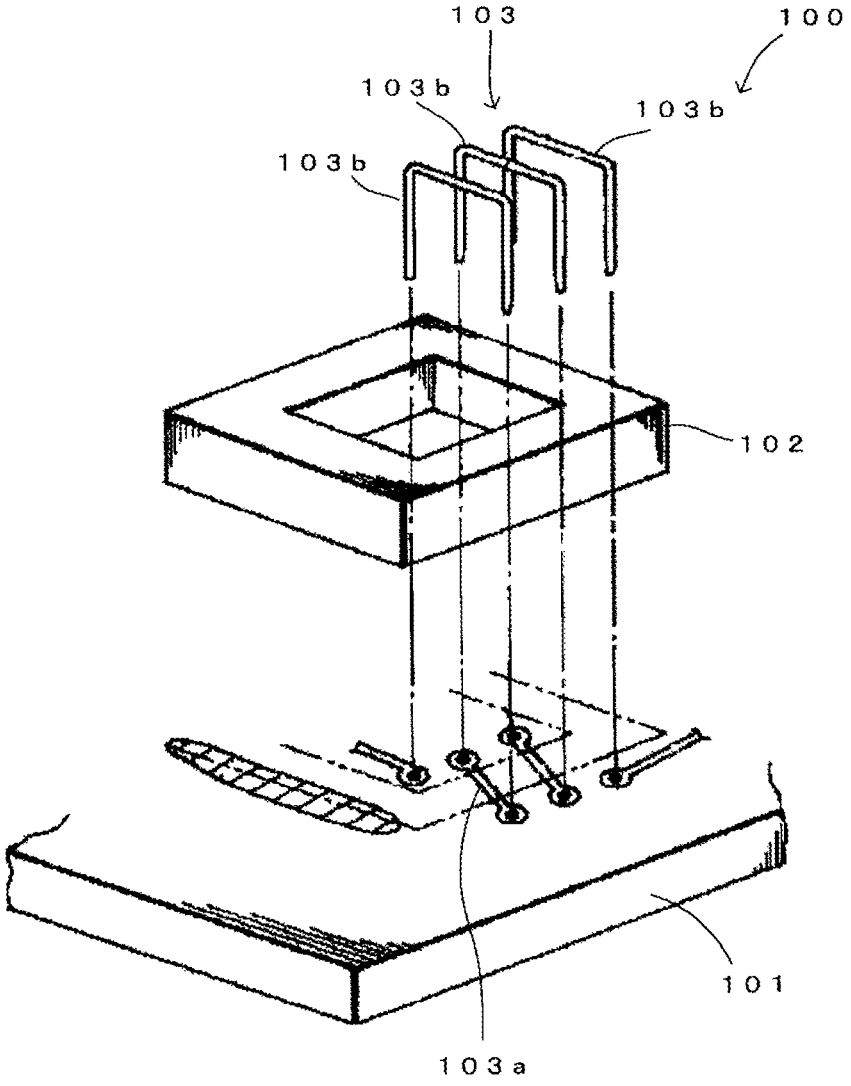
FIG. 9 is an exploded perspective view of an existing coil module.

For example, as illustrated in FIG. 8A, a collective substrate 150, which has substantially the same structure as the collective substrate 15 illustrated in FIG. 6A, is prepared, and a plurality of through-holes 160 are formed at predetermined positions in the collective substrate 150. Each of the through-holes 160 is substantially circular and formed across a boundary between the wiring substrates 20*a* that are adjacent to each other. The through-holes 160 are formed so that, when the collective body of the coil modules 1*b* is diced into independent coil modules 1*b*, the first and second resin substrates 20*b* and 20*c*, which are semicircular in plan view, are formed (see FIG. 8B).

With this structure, the coil module 1*b* can have the same advantages as the coil module 1*a* according to the first embodiment.

The present disclosure is not limited to the embodiments described above, which may be modified within the spirit and scope of the present disclosure. For example, the wiring substrates 2*a* and 20*a* may be made of, for example, a ceramic material.

In the embodiments described above, the coil module 1*a* and 1*b* are antenna modules. A coil module according to the present disclosure may be a coil module of a different type, as long as the coil module includes the coil electrode 4 and the wiring substrate 2*a* or 20*a*.

In the embodiments described above, the components 7*a* to 7*c* are disposed on the upper surfaces of the wiring substrates 2*a* or 20*a*. Alternatively, some or all of the components 7*a* to 7*c* may be disposed on the lower surfaces of the wiring substrates 2*a* and 20*a*.

The present disclosure can be applied to a variety of coil modules including a wiring substrate and a coil electrode.

While preferred embodiments of the disclosure have been described above, it is to be understood that variations and modifications will be apparent to those skilled in the art without departing from the scope and spirit of the invention. The scope of the invention, therefore, is to be determined solely by the following claims.

What is claimed is:

1. A coil module comprising:

a substrate layer having a first main surface and a second main surface facing opposite directions, the substrate layer including a wiring substrate and a resin substrate arranged adjacent to each other that define the first main surface of the substrate layer;

a coil electrode including a plurality of columnar conductors, wherein each of the columnar conductors extends through the resin substrate in such a way that a first end each of the columnar conductors is exposed on the first main surface of the substrate layer; and a sealing resin layer stacked on the second main surface of the substrate layer that covers the columnar conductors, the sealing resin layer having a stacking surface that faces the second main surface of the substrate layer, wherein a second end of each of the columnar conductors is exposed on an opposite surface of the sealing resin layer opposite to the stacking surface of the sealing resin layer wherein each of the columnar conductors and a corresponding one of the columnar conductors are paired and connected to each other on the first main surface of the substrate layer through a first conductive layer, and wherein each of the columnar conductors and a corresponding one of the columnar conductors are paired and connected to each other on the opposite surface of the sealing resin layer through a second conductive layer.

2. The coil module according to claim 1, wherein the columnar conductors are metal pins.

3. The coil module according to claim 2, wherein the coil electrode is an antenna coil.

4. The coil module according to claim 2, wherein the sealing resin layer is made of a resin including magnetic powder.

5. The coil module according to claim 2, wherein the resin substrate of the substrate layer includes a first resin substrate and a second resin substrate, and the wiring substrate is disposed between the first resin substrate and the second resin substrate such that the wiring substrate, first resin substrate, and second resin substrate together define the first main surface of the substrate layer, and wherein the plurality of columnar conductors are paired so that one of the columnar conductors of each pair extends through the first resin substrate and another one of the columnar conductors of the pair extends through the second resin substrate.

6. The coil module according to claim 2, wherein a part of the first conductive layer on the first main surface of the substrate layer is disposed on the wiring substrate.

7. The coil module according to claim 2, wherein the coil electrode is wound so as to generate magnetic flux in a direction parallel to the first main surface or the second main surface of the substrate layer.

8. The coil module according to claim 1, wherein the coil electrode is an antenna coil.

9. The coil module according to claim 8, wherein the sealing resin layer is made of a resin including magnetic powder.

10. The coil module according to claim 8, wherein the resin substrate of the substrate layer includes a first resin substrate and a second resin substrate, and the wiring substrate is disposed between the first resin substrate and the second resin substrate such that the wiring substrate, first resin substrate, and second resin substrate together define the first main surface of the substrate layer, and wherein the plurality of columnar conductors are paired so that one of the columnar conductors of each pair extends through the first resin substrate and another one of the columnar conductors of the pair extends through the second resin substrate.

11. The coil module according to claim 8, wherein a part of the first conductive layer on the first main surface of the substrate layer is disposed on the wiring substrate.

12. The coil module according to claim 1, wherein the sealing resin layer is made of a resin including magnetic powder.

13. The coil module according to claim 12, wherein the resin substrate of the substrate layer includes a first resin substrate and a second resin substrate, and the wiring substrate is disposed between the first resin substrate and the second resin substrate such that the wiring substrate, first resin substrate, and second resin substrate together define the first main surface of the substrate layer, and wherein the plurality of columnar conductors are paired so that one of the columnar conductors of each pair extends through the first resin substrate and another one of the columnar conductors of the pair extends through the second resin substrate.

14. The coil module according to claim 12, wherein a part of the first conductive layer on the first main surface of the substrate layer is disposed on the wiring substrate.

15. The coil module according to claim 1, wherein the resin substrate of the substrate layer includes a first resin substrate and a second resin substrate, and the wiring substrate is disposed between the first resin substrate and the second resin substrate such that the wiring substrate, first resin substrate, and second resin substrate together define the first main surface of the substrate layer, and wherein the plurality of columnar conductors are paired so that one of the columnar conductors of each pair extends through the first resin substrate and another one of the columnar conductors of the pair extends through the second resin substrate.

16. The coil module according to claim 15, wherein the first conductive layer is disposed on the first main surface of the substrate layer so as to extend from the first resin substrate to the second resin substrate across the wiring substrate.

17. The coil module according to claim 16, wherein a part of the first conductive layer on the first main surface of the substrate layer is disposed on the wiring substrate.

18. The coil module according to claim 15, wherein a part of the first conductive layer on the first main surface of the substrate layer is disposed on the wiring substrate.

19. The coil module according to claim 15, wherein the sealing resin layer is stacked on the second main surface of the substrate layer so as to extend from the first resin substrate to the second resin substrate across the wiring substrate.

20. The coil module according to claim 1, wherein a part of the first conductive layer on the first main surface of the substrate layer is disposed on the wiring substrate.

21. The coil module according to claim 1, wherein the coil electrode is wound so as to generate magnetic flux in a direction parallel to the first main surface or the second main surface of the substrate layer.

22. The coil module according to claim 1, wherein the first end of each of the columnar conductors is flush with the first main surface of the substrate layer and the second end of each of the columnar conductors is flush with the opposite surface of the sealing resin layer.

23. The coil module according to claim 1, wherein the wiring substrate and resin substrate are aligned adjacent to each other in a lateral direction that is perpendicular to a stacking direction of the substrate layer and sealing resin layer.

* * * * *